US009500065B2

(12) United States Patent
Jensen

(10) Patent No.: US 9,500,065 B2
(45) **Date of Patent: *Nov. 22, 2016**

(54) NOZZLE ASSEMBLY

(71) Applicant: Schlumberger Technology Corporation, Sugar Land, TX (US)

(72) Inventor: Michael Jensen, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/922,901

(22) Filed: Oct. 26, 2015

(65) Prior Publication Data

US 2016/0047202 A1 Feb. 18, 2016

Related U.S. Application Data

(63) Continuation of application No. 14/029,692, filed on Sep. 17, 2013, now Pat. No. 9,169,718.

(51) Int. Cl.

| | |
|---|---|
| ***E21B 37/00*** | (2006.01) |
| ***E21B 41/00*** | (2006.01) |
| ***E21B 27/00*** | (2006.01) |

(52) U.S. Cl.

CPC ..... *E21B 37/00* (2013.01); *E21B 27/00* (2013.01); *E21B 41/0078* (2013.01)

(58) Field of Classification Search

CPC combination set(s) only.

See application file for complete search history.

(56) References Cited

U.S. PATENT DOCUMENTS

| | | | | |
|---|---|---|---|---|
| 2,263,850 | A * | 11/1941 | Nielsen | F16N 21/04 285/102 |
| 4,040,650 | A | 8/1977 | Shotblot | |
| 4,045,054 | A | 8/1977 | Arnold | |
| 4,180,285 | A | 12/1979 | Reneau | |
| 6,640,897 | B1 | 11/2003 | Misselbrook et al. | |
| 7,878,247 | B2 | 2/2011 | Misselbrook et al. | |
| 9,169,718 | B2 | 10/2015 | Jensen | |
| 2010/0243258 | A1 | 9/2010 | Fishbeck et al. | |
| 2012/0048569 | A1 | 3/2012 | Williams | |

OTHER PUBLICATIONS

International Search Report and the Written Opinion for International Application No. PCT/US2014/055300 dated Dec. 22, 2014.

* cited by examiner

*Primary Examiner* — David Andrews
*Assistant Examiner* — Ronald Runyan
(74) *Attorney, Agent, or Firm* — Trevor G. Grove

(57) ABSTRACT

A nozzle assembly including a nozzle. The nozzle has an elongated body. The elongated body has a nozzle end at one end and a connection portion at another end. A joint section is connected with the connection portion. The joint section allows the nozzle to move axially and radially when an axial force is applied to the nozzle end.

7 Claims, 6 Drawing Sheets

NOZZLE ASSEMBLY

CROSS-REFERENCE TO RELATED APPLICATIONS

This Application is a continuation of co-pending U.S. patent application Ser. No. 14/029,692, which was filed on Oct. 27, 2015, entitled Nozzle Assembly. The foregoing application is incorporated herein by reference.

FIELD OF THE DISCLOSURE

The disclosure generally relates to a nozzle assembly and systems and methods for debris collection that utilize the nozzle assembly.

BACKGROUND

Tools used in wells often have a component that is located along a low side of a well. For example, debris removal devices need to have a suction port or nozzle inlet located at the low side of a well. Obstructions in a well make conveyance of tools having components located at the low side of the well difficult. To aid in the conveyance bullnoses are used to push the tool towards the center of the well. Bullnoses, however, can be cumbersome and add size and weight to the tool as well as impede the orientation functionality required. A need, therefore, exists for a nozzle assembly that functions similar to a bullnose without the restrictions imposed by conventional bullnose designs.

SUMMARY

An embodiment of a nozzle assembly can include a nozzle. The nozzle can have an elongated body. The elongated body can have a nozzle end located at one end and a connection portion located at another end. The connection portion can be connected with a joint section. The joint section can allow the nozzle to move axially and radially when an axial force is applied to the nozzle end.

An embodiment of a system for collecting debris can include the nozzle assembly connected with a suction tool.

An embodiment of a method for debris removal in a well can include moving a system for debris removal in a well and moving the nozzle radially and axially when axial force from an obstruction is applied to a portion of the nozzle. The method can also include positioning the suction tool at a desired location in the well and performing a debris removal operation.

DETAILED DESCRIPTION OF THE INVENTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

An example nozzle assembly includes a nozzle. The nozzle can have an elongated body. The elongated body can have a nozzle end at one end and a connection portion at another end. The connection portion can be a ball, a linkage, or other joint connection.

The nozzle assembly can also include a joint section. The joint section connects with the connection portion. The joint section allows the nozzle to move axially and radially when an axial force is applied to the nozzle end. For example, the joint section and the connection can form a ball joint, and a wedge contact on the joint section can cause the nozzle to move radially and axially as an axial force is applied to the nozzle end. The joint section and connection portion can connect in any manner that allows the nozzle to move radially and axially when an axial force is applied to the nozzle. The joint section can have any configuration that is configured to connect with the connection portion. The joint section and connection portion can be a pair of links, a ball joint, or the like.

The nozzle assembly can be connected with a suction tool to form a system for collecting debris. The suction tool can be configured to connect with a wireline, a slickline, a tool string, a tubular string, or other well conveyance device.

Figure 1:
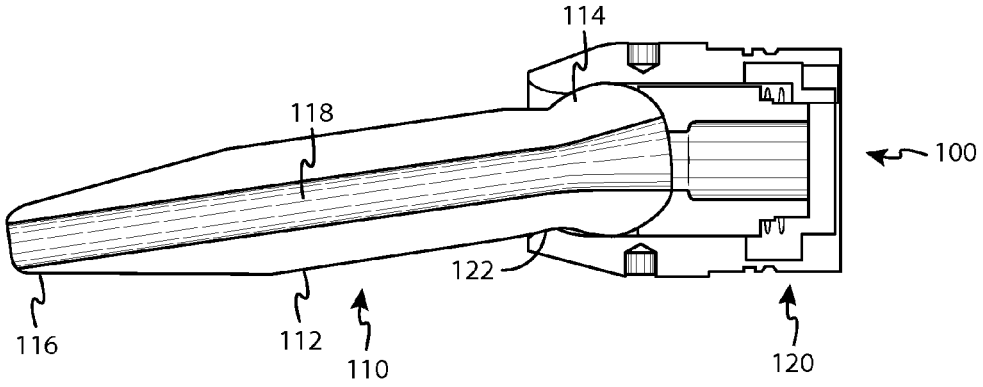
FIG. 1 depicts an embodiment of a nozzle assembly.
Figure 2:
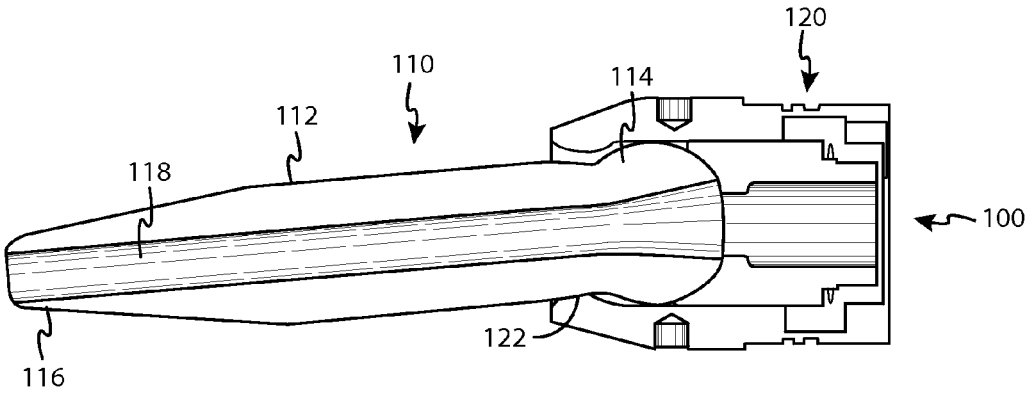
FIG. 2 depicts the nozzle assembly of FIG. 1 with a nozzle moved axially and radially.
Figure 3:
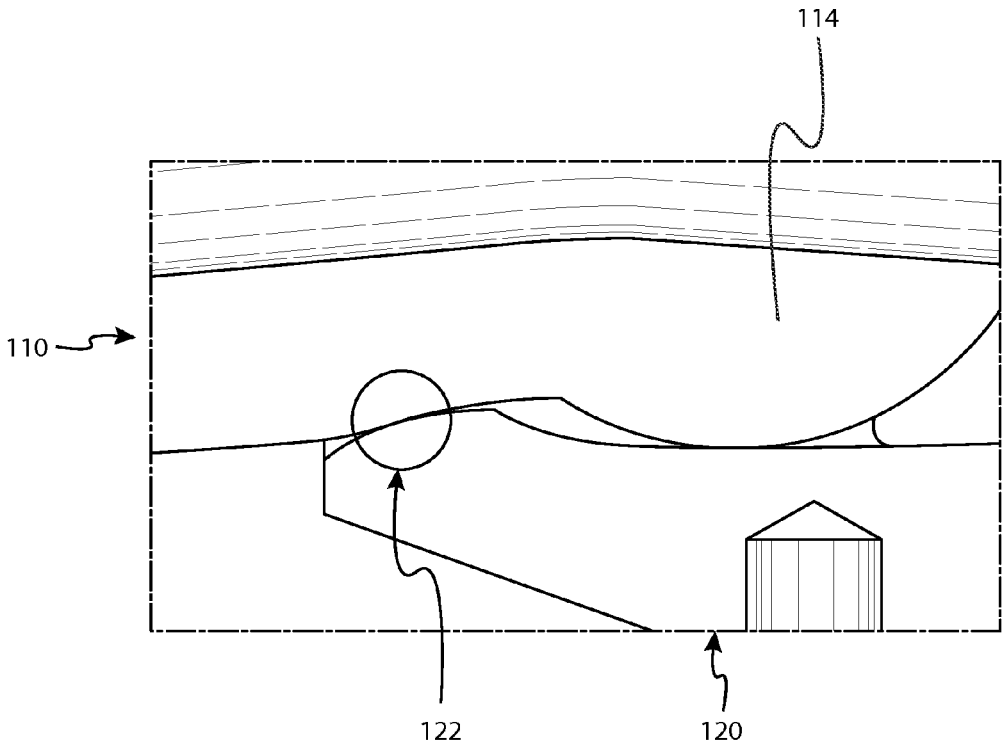
FIG. 3 depicts a detailed view of the nozzle assembly of FIG. 1.

Turning now to the Figures. FIG. 1 depicts an embodiment of a nozzle assembly. FIG. 2 depicts the nozzle assembly of FIG. 1 with a nozzle moved axially and radially. FIG. 3 depicts a detailed view of the nozzle assembly of FIG. 1.

Referring now to FIGS. 1 to 3, the nozzle assembly 100 can include a nozzle 110 and a joint section 120.

The nozzle 110 has an elongated body 112. The elongated body 112 has a nozzle end 116 and a connection portion 114. The nozzle 110 can have a flow path 118 formed therethrough.

The joint section 120 connects with the connection portion 114. For example, as depicted in FIGS. 1 to 3, the joint section 120 and connection portion 114 can form a ball joint. The joint section 120 can be configured to allow the nozzle 110 to move axially when an axial force is applied to the nozzle end 116. The axial force can be applied by an obstruction in the well. In addition, the joint section 120 is configured to transfer a portion of the axial force to a radial force, causing the nozzle 110 to move radially. For example, as shown in FIGS. 1 to 3, a wedge contact 122 can transfer some of the axial force to a centering force, causing radial motion to be imparted to the nozzle 110. The geometry of the wedge contact 122 can have a geometry that provides a mechanical advantage sufficient to make the centering force greater than the opposing friction generated by the axial force and the obstruction. One skilled in the art, with the aid of this disclosure, would be able to calculate the geometry of the contact portion without undue experimentation.

Figure 4:
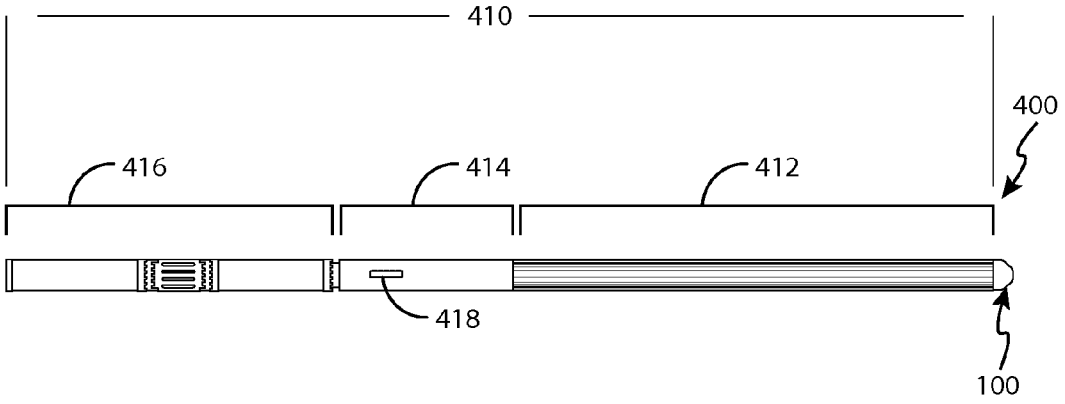
FIG. 4 depicts an embodiment of a system for debris removal.

FIG. 4 depicts an embodiment of a system for debris removal. The system 400 includes a suction tool 410 with the nozzle assembly 100 connected therewith. The suction tool 410 includes a debris storage section 412, a pump section 414, and a power section 416. The suction tool 410 can also include ports 418.

Figure 5:
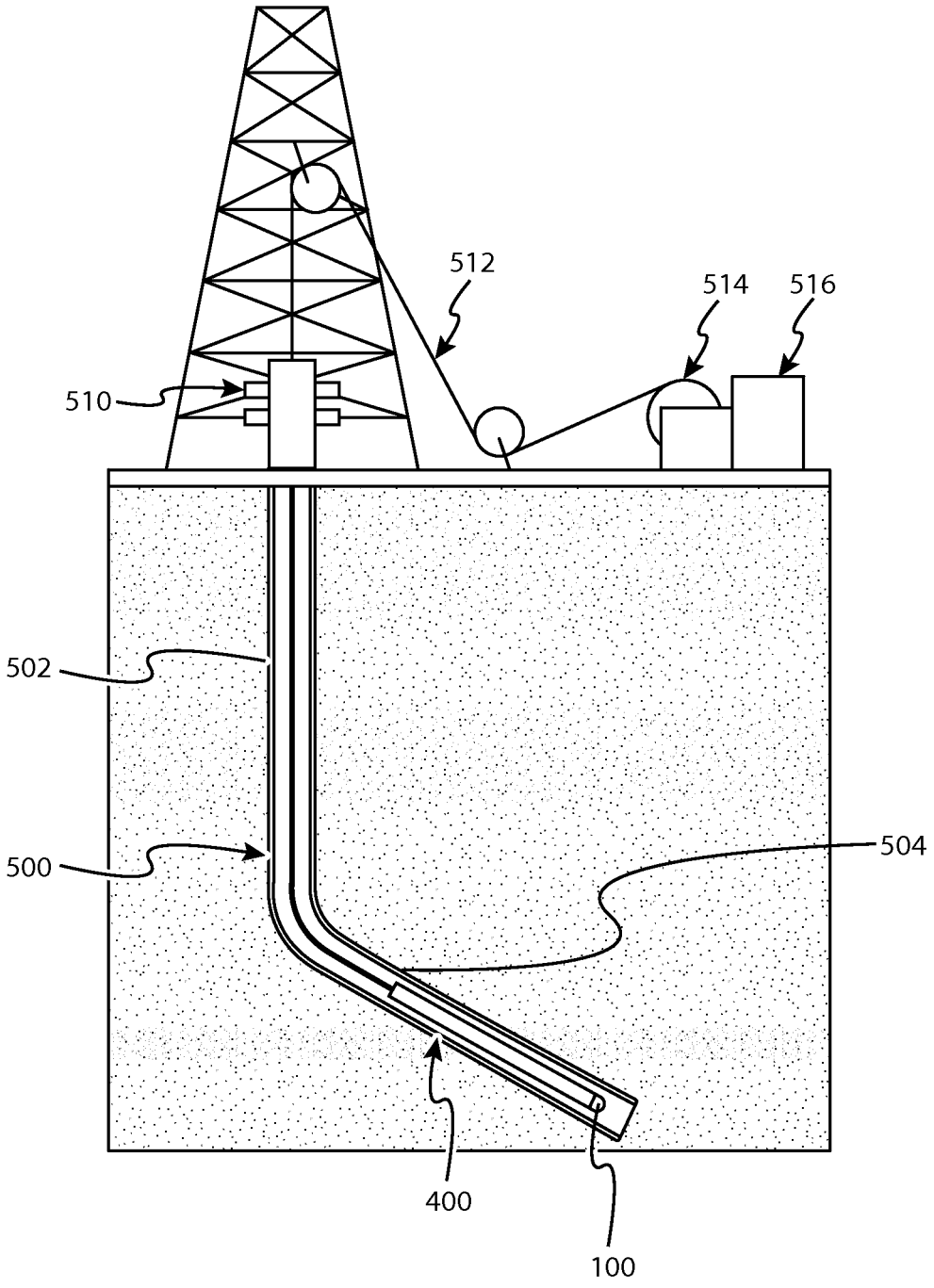
FIG. 5 depicts an embodiment of the system of FIG. 4 located in a well.

FIG. 5 depicts an embodiment of the system of FIG. 4 located in a well.

The system 400 can be connected with a wireline 512. The wireline 512 is operatively connected with a winch 514 and a control unit 516. A derrick 510 supports the wireline 512. The wireline 512 is used to move the system 400 into the well 500. The well 500 can have a vertical section 502 and a deviated section 504. The system 400 can be moved within the well 500. The system 400 can be poisoned in the deviated section 504 to perform a debris removal operation, and the nozzle assembly 100 allows the nozzle end to be oriented in a proper position relative to the well 500.

Figure 6:
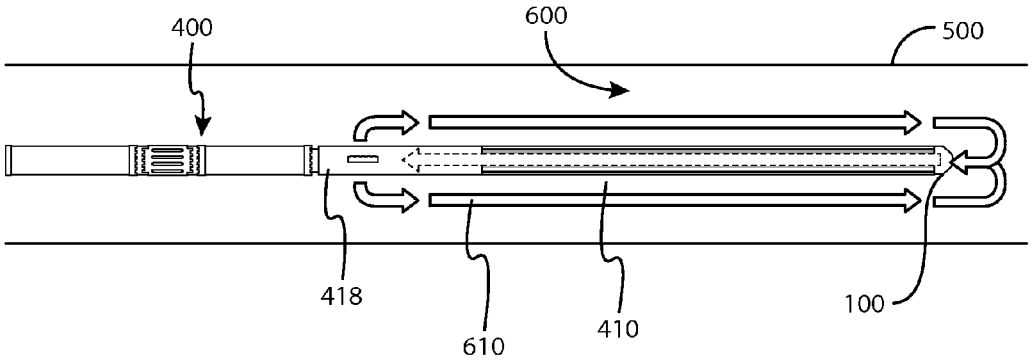
FIG. 6 depicts an example of a flow path generated in the well of FIG. 5 during debris removal operations.

FIG. 6 depicts an example of a flow path generated in the well of FIG. 5 during debris removal operations. An annulus 600 can be formed between the system 400 and the well 500. To perform the debris removal operation, fluid 610 is discharged from ports 418. The fluid 610 traverses the annulus 600 and collects debris in the annulus 600. The fluid 610 and collected debris are drawn through the nozzle assembly 100 to the debris storage section 410. The debris storage section 410 removes the debris from the fluid 610, and the fluid 610 can then be circulated back to the annulus to collect additional debris.

Figure 7:
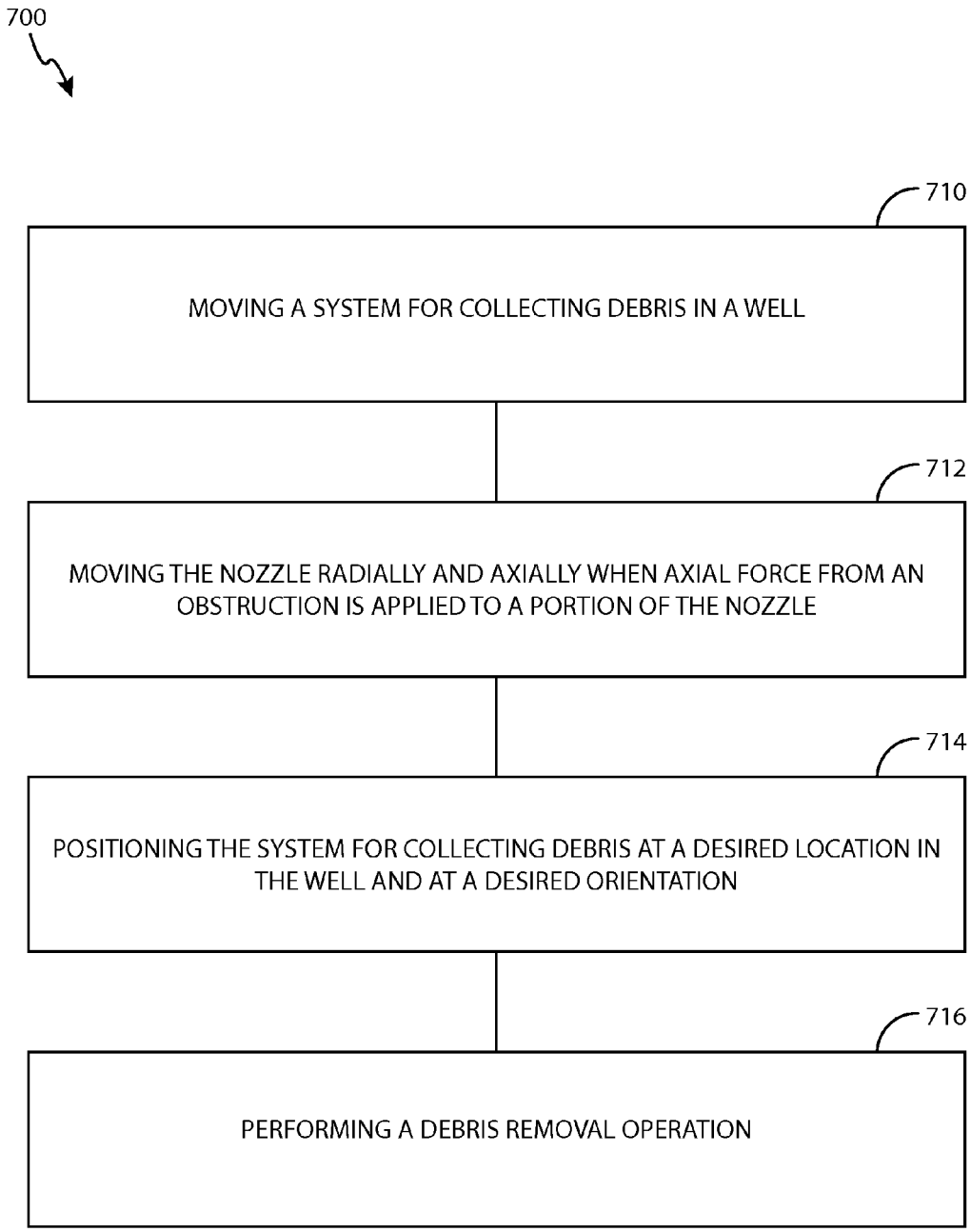
FIG. 7 depicts an embodiment of a method for debris removal in a well.

FIG. 7 depicts an embodiment of a method for debris removal in a well.

The method 700 is depicted as a plurality of blocks or operations. The method 700 includes moving a system for collecting debris in a well (block 710). The system for collecting debris includes a nozzle assembly connected with a suction tool, and the nozzle assembly includes a nozzle.

The method also includes moving the nozzle radially and axially when axial force from an obstruction is applied to a portion of the nozzle (block 712). The method can also include positioning the system for collecting debris at a desired location in the well and at a desired orientation (block 714). The desired orientation can be any relationship with the well required to perform a desired operation. For example, the desired orientation can be such that a suction port for a debris collection tool is allowed to be located along the low side of completion tubular or well. The method can also include performing a debris removal operation (block 716).

Although example assemblies, methods, systems have been described herein, the scope of coverage of this patent is not limited thereto. On the contrary, this patent covers every method, nozzle assembly, and article of manufacture fairly falling within the scope of the appended claims either literally or under the doctrine of equivalents.

What is claimed is:

1. A system for collecting debris, wherein the system is used in a well, and wherein the system comprises:
- a nozzle assembly comprising:
  - a nozzle comprising:
    - an elongated body;
    - a nozzle end located on one end of the elongated body; and
    - a connection portion located at another end of the elongated body; and
  - a joint section connected with the connection portion, wherein the joint section allows the nozzle to move axially and radially when an axial force is applied to the nozzle end; and
- a suction tool connected with the joint section.

2. The system of claim 1, wherein the connection portion is a ball.

3. A method for debris removal in a well, wherein the method comprises:
- moving a system for collecting debris in a well, wherein the system for collecting debris comprises a nozzle assembly, wherein the nozzle assembly comprises a nozzle;
- moving the nozzle radially and axially when axial force from an obstruction is applied to a portion of the nozzle; and
- positioning the system for collecting debris at a desired location in the well and performing a debris removal operation.

4. The method of claim 3, wherein the nozzle comprises:
- an elongated body;
- a nozzle end located on one end of the elongated body; and
- a connection portion located at another end of the elongated body.

5. The method of claim 4, wherein a joint section is connected with the connection portion, wherein the joint section allows the nozzle to move axially and radially when an axial force is applied to the nozzle end.

6. The method of claim 5, wherein the joint section is connected with a suction tool.

7. The method of claim 5, wherein the joint section comprises:
- a wedge contact to provide radial motion to the nozzle when the axial force is applied to the nozzle end.

* * * * *